United States Patent [19]

Gazzarrini

[11] Patent Number: 4,532,875

[45] Date of Patent: Aug. 6, 1985

[54] PROCESS AND A MACHINE FOR THE AUTOMATIC TRANSFER OF PANTYHOSE FROM A MACHINE WHICH PRODUCES A PANTYHOSE WITH SEAMS TO A GUSSET-SEWING MACHINE

[75] Inventor: Vinicio Gazzarrini, Florence, Italy

[73] Assignee: Solis S.r.l., Florence, Italy

[21] Appl. No.: 568,700

[22] Filed: Jan. 6, 1984

[30] Foreign Application Priority Data

Jan. 21, 1983 [IT] Italy ..... 9316 A/83

[51] Int. Cl.[3] ..... D05B 21/00; D05B 97/00

[52] U.S. Cl. ..... 112/262.2; 112/104; 112/121.15; 112/262.3

[58] Field of Search ..... 112/121.15, 121.12, 112/121.11, 121.29, 262.2, 262.1, 262.3, 104; 223/43

[56] References Cited

U.S. PATENT DOCUMENTS 4,485,753 12/1984 Silla ..... 112/121.15 X

FOREIGN PATENT DOCUMENTS 16437 10/1980 European Pat. Off. ..... 112/121.15

2040157 8/1980 United Kingdom ..... 112/121.15

*Primary Examiner*—H. Hampton Hunter

*Attorney, Agent, or Firm*—McAulay, Fields, Fisher, Goldstein & Nissen

[57] ABSTRACT

Apparatus for automatically transferring pantyhose from a machine producing pantyhose with seams to a gusset-sewing machine, which includes a pronged catching device for a rapid and correct elastic catching or grabbing of the garment with its prongs which are first introduced into a central opening of the garment, which is left seamless at the central opening immediately after the garment leaves the pantyhose producing machine, provision being made to effect a preliminary transverse opening out the garment opening during the horizontal transfer of the garment toward the catching device and the simultaneous separate drawing of the legs of the garment into appropriate tubes so that at the end of the transfer of the garment, the edge of the garment opening is automatically arranged all around the prongs of the pronged catching device. An opening device is used to make the preliminary transverse opening, the opening device having claws which oscillate vertically to permit the preliminary transverse horizontal opening out of the edge of the garment opening; furthermore, the claws are horizontally rotatable to enable the claws to enter/exit into/from the opening and finally the claws are horizontally movable to make it possible to accompany the garment from the outlet of the machine which produces the pantyhose to the catching device.

17 Claims, 7 Drawing Figures

PROCESS AND A MACHINE FOR THE AUTOMATIC TRANSFER OF PANTYHOSE FROM A MACHINE WHICH PRODUCES A PANTYHOSE WITH SEAMS TO A GUSSET-SEWING MACHINE

BACKGROUND OF THE INVENTION

This invention relates to improvements concerning a process and a machine for automatic transfer of pantyhoses from a machine for manufacturing pantyhoses with seams to a gusset-sewing machine.

DESCRIPTION OF PRIOR ART

According to European Pat. No. 82830194.5, which is effective in Italy, filed by the same applicant, there is a known machine equipped with a catching device with prongs capable of opening out, intended to be introduced in a closed condition into the central opening of the garment to be transferred, which is left seamless at the opening to receive the gusset, and subsequently intended to be opened out to stretch the opening, obtaining an elastic catching of the garment and permitting its subsequent transfer, in a hanging-down configuration, to the gusset-sewing machine. Previously, and up to the introduction of the prongs of the catching device into the opening in the garment, and for the purpose of enabling the prongs to access the opening, the machine covered by the aforesaid patent provides for drawing the legs of the garment into two vertical tubes, separate but aligned when the panty of the garment is initially held onto the machine which produces the pantyhoses and also after it leaves the machine.

IMPROVEMENT

Now, experience has shown that sometimes the prongs cannot enter into the opening and they remain entangled in the fabric; this is due, in part, to causes inherent in the machine which produces the pantyhoses, because the opening in the garment which is left seamless is asymmetrical relative to the axis of the catching device, whose prongs are preparing to enter into the opening and in part to the separate pneumatic suction of the legs, which further favors the asymmetry and also tends to deform initially, the oval edge of the opening, in the sense that it lengthens it vertically and simultaneously shortens it horizontally; finally, this drawback is all the more marked the greater the weight of the garment. The intended purpose of the present improvements is to eliminate this drawback. This result was obtained according to the invention by suggesting a preliminary transverse opening out of the opening in the garment be left seamless prior to its being caught by the catching device in the machine which effects the transfer, and to such an extent as to enable the edge of the opening to be arranged all around the closed prongs in the catching device, which is in position to start the transfer.

This makes it possible to catch correctly and rapidly all the garments coming out of the machine which produces the pantyhoses.

BRIEF DESCRIPTION OF THE DRAWING

These and further advantages and features of the invention will be better and more fully understood by any expert of the art from the following description and with the accompanying aid of the attached drawings, given as an example of the invention, but not to be regarded as limiting its scope; wherein.

DETAILED DESCRIPTION OF THE INVENTION

Figure 2:
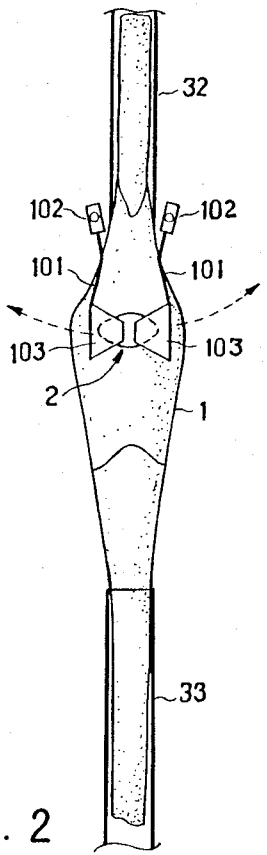
FIG.2 is a front view of the device shown in FIG. 1.
Figure 1:
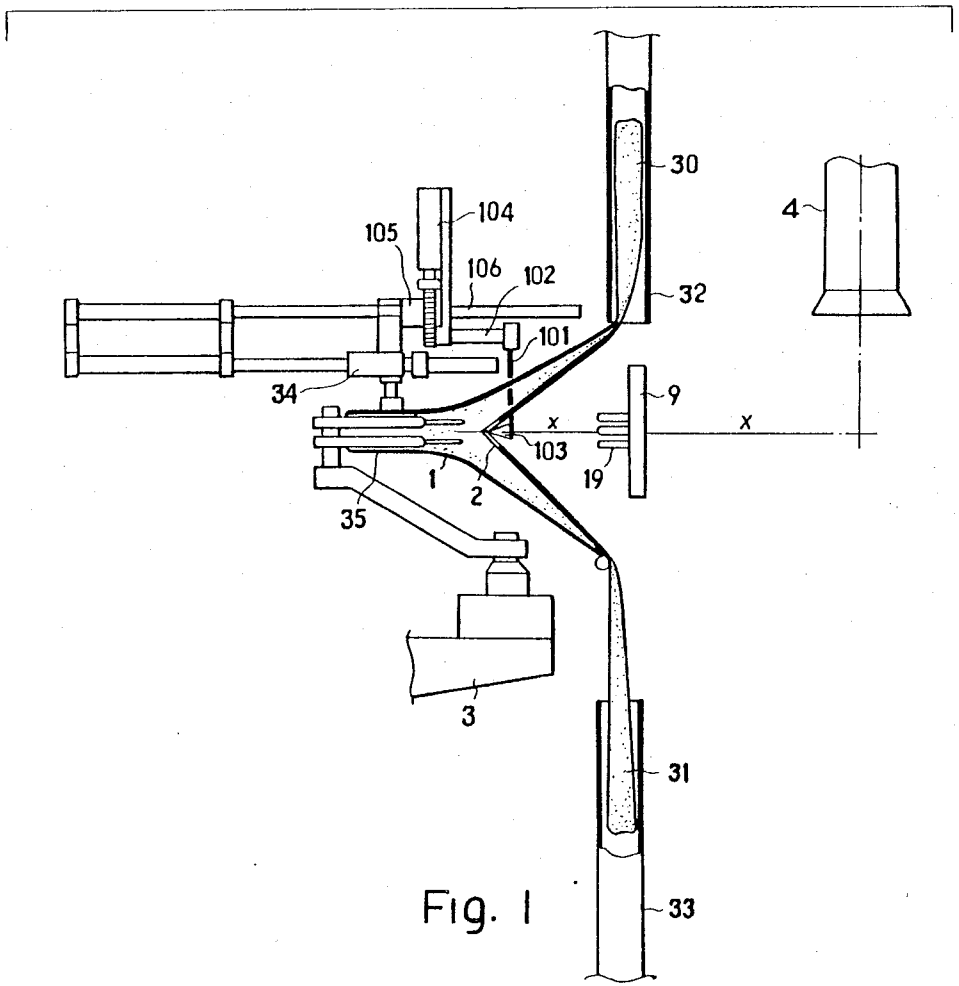
FIG. 1 is a side view of an opening device according to the invention in the configuration in which the garment is held when it leaves the machine which produces the pantyhoses.
Figure 3:
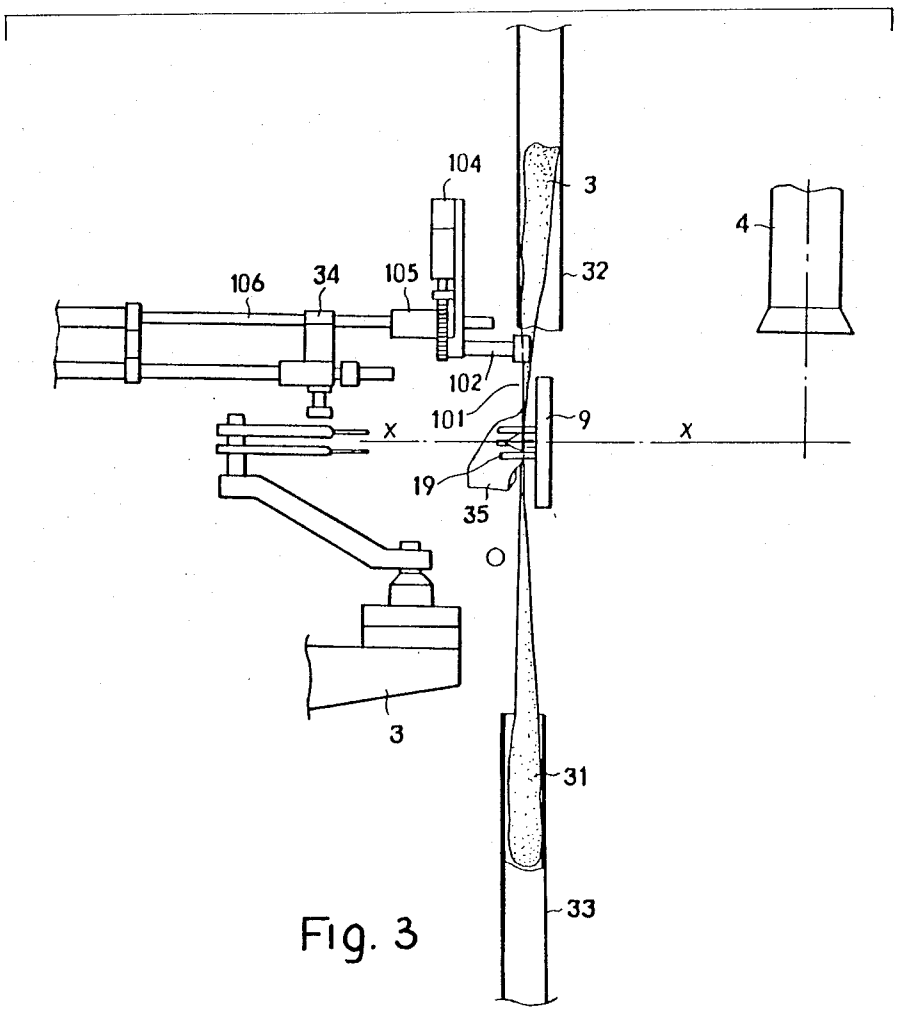
FIG. 3 is a side view of the device shown in FIG. 1 in the configuration in which the garment, removed from the machine which produces the pantyhoses, moves toward the transfer device to the gusset-sewing machine.

The improvement covered by the present invention and concerning the method for the automatic transfer of pantyhoses from a machine which produces pantyhoses with seams to a machine for sewing pantyhose gussets comprises a stage—which starts as soon as the panty (35) of the garment (1) has left the machine (3) which produces the pantyhoses and ends as soon as the garment has reached pronged catching device (9)—which consists of a preliminary transverse opening out of the edge of the opening (2), simultaneous with the horizontal approach of the garment (1) to the catching device (9), which is positioned in front of the exit station of the machine (3), in combination with the separate drawing of the legs (30-31) of the garment (1) into their respective tubes (32-33). The improvement covered by the present invention and concerning the machine for the automatic transfer of pantyhoses from a machine which produces pantyhoses with seams to a gusset-sewing machine comprises an opening system composed of:

two arms (101), identical and symmetrically oriented relative to the tube (32) for drawing in one leg (30) of the garment (1), articulated at right angles, in the same vertical plane, onto two horizontal shafts (102), capable also of rotating, by known means, around themselves and in opposite directions; at the free end of the arms (101) there is fixed a claw (103), practically triangular, of flat shape and bent at right angles, the tip of which is designed to be introduced into the opening (2) of the garment (1). The tips of the claws (103) are so arranged that, relative to the rotation of the arms (101) around themselves, they either point toward the same side (as shown in FIG. 1) or against each other (as shown in FIG. 3).

Two side-by-side horizontal shafts (102), rotating in opposite directions, operated, by known means, by a fractional-, intermittent-stroke pneumatic cylinder (104), so that the claws (103) follow an identical, intermittent angular path in opposite directions, in the second and third quadrants, respectively, and so that initially, that is, at the lower dead center, the tips of the two claws are very close to and opposite each other; a first segment of the stroke is intended to perform the preliminary opening out of the edge of the opening (2) and a second segment is intended to distance the claws (103) after releasing the garment (1) as a result of their horizontal rotation.

A carriage (105) supporting the cylinder (104) with the related shafts (102), movable in alternating directions along a horizontal track (106), above the outlet station of the machine (3) which produces the pantyhoses and parallel to the axis X-X of the catching device (9); the carriage (105) is operated by the cart (34) of the machine which transfers the pantyhoses and starts its outward run with a delay relative to the latter cart (34), to enable the tips of the claws (103) to be securely introduced into the opening (2) and subsequently to follow the movement of the garment while it approaches the catching device (9) and, during the return run, to return to their initial position.

Figure 4:
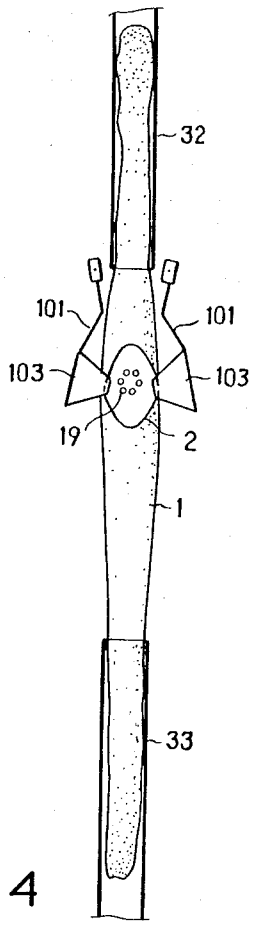
FIG. 4 is a front view of the device shown in FIG. 2.
Figure 7:
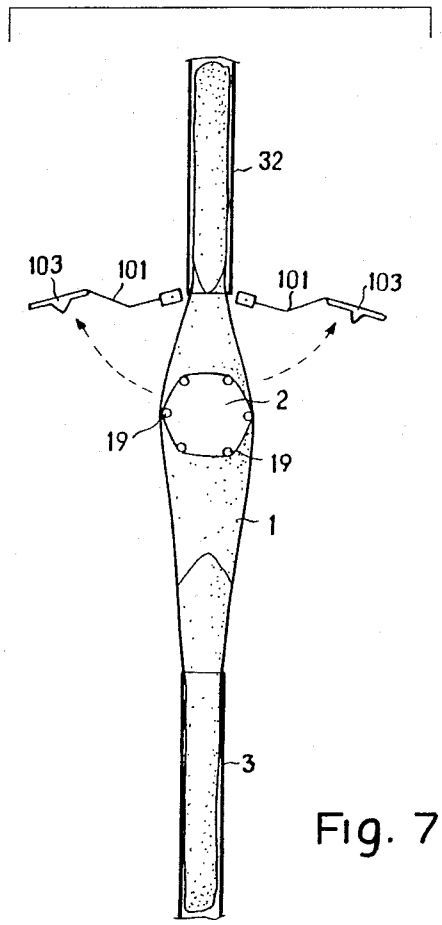
FIG. 7 is a front view of the device shown in FIG. 6.
Figure 6:
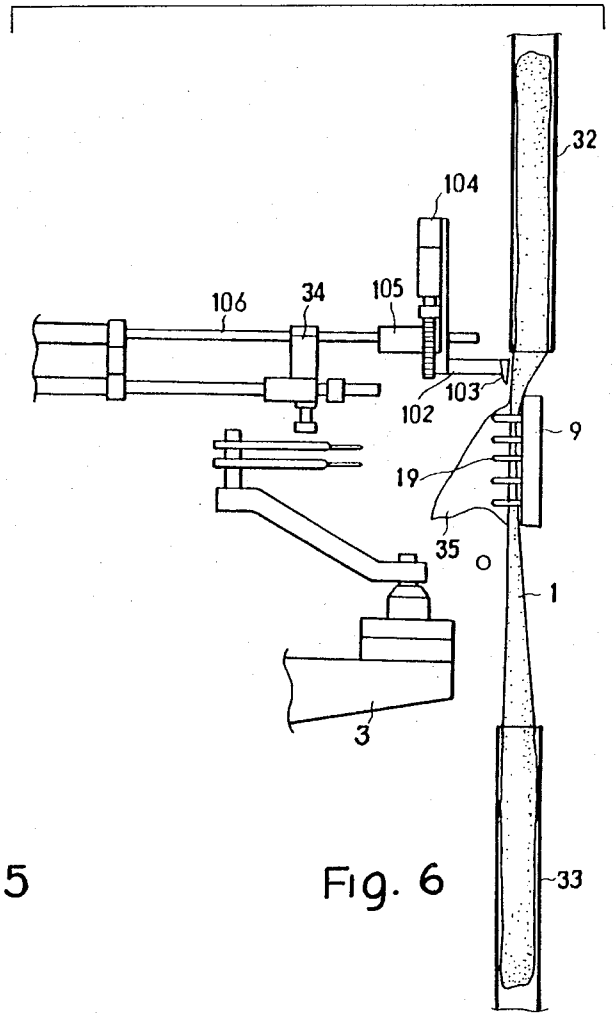
FIG. 6 is a side view of the device shown in FIG. 1 in the configuration in which the garment presents its opening fully opened out by the catching device, to be transferred to the gusset-sewing machine.
Figure 5:
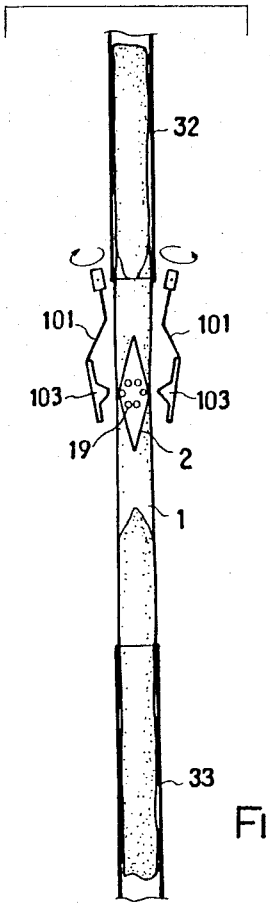
FIG. 5 is a front view of the device shown in FIG. 1 in the configuration in which the garment presents its opening after the end of its opening out, with the closed prongs of the catching device inside it, to be transferred to the gusset-sewing machine.

Known means to control the movement of the arms (101) and carriage (105), whose coordinated operation is governed by a cam (not shown in the drawing for simplicity's sake) in the machine which effects the transfer of the pantyhoses, in such manner that the claws (103) are at the lower dead center and in the closed configuration (as shown in FIG. 2) when the catching device (9) is oriented with its X-X axis horizontal and in the position facing the outlet of the machine (3) which produces the pantyhoses, and subsequently—during the outward run of the carriage (105)—partially open out after being contacted by the garment (1) through its opening (2) (as in FIG. 4); then they rotate toward the outside of the garment (1) to place the latter onto the prongs (19) of the catching device (9) (as in FIG. 5) and finally open out as far as possible (as in FIG. 7), to make it possible to move beyond the garment (1) during the return run of the carriage (105) and simultaneously to permit the passage of the carousel of the machine (3) which produces the pantyhoses; at the end of the return run, said movements of the claws (103) are repeated in reverse order to enable them to resume their initial position shown in FIG. 2. In practice, the detailed embodiment of the invention may vary anyway with respect to the shape, size and arrangement of the components and the nature of the materials used, without however exceeding the scope of the idea adopted as a solution and therefore remaining within the scope of the protection granted by the present patent for industrial invention.

I claim:

1. A process for the automatic transfer of pantyhoses from a machine which produces pantyhoses with seams to a machine for sewing the gussets of pantyhoses, comprising:

leaving a preliminary horizontal opening out of the edge of the garment both after the garment has left the pantyhose machine and during the horizontal approach of the garment to a catching device, leaving said preliminary opening during the separate drawing of the legs of the garment into appropriate tubes; and leaving said preliminary horizontal opening out of the edge of the garment seamless, so that, when the garment reaches said catching device, the edge of said opening is arranged around closed prongs forming part of said catching device.

2. Apparatus for the automatic transfer of pantyhoses from a first machine for producing pantyhoses with seams to a second machine for sewing gussets to the pantyhoses, comprising:

a device for the preliminary opening out of the opening of a pantyhose garment, including two identical arms, symmetrically arranged relative to an upper tube for drawing thereinto one leg of the garment and articulated onto two horizontal shafts capable of rotating around themselves;

two triangular claws, each of flat shape, bent at right angles, and symmetrically fixed to the ends of said identical arms;

two horizontal shafts carrying said arms in a hanging-down position, rotating in opposite directions and each of said horizontal shafts being operated by a pneumatic cylinder;

a carriage movable in alternating directions along a horizontal track, placed above the outlet station of the first machine for producing the pantyhoses and carrying said horizontal shafts and said cylinder; and means to control the movements of said identical arms, said shafts and said carriage, synchronized with the positions assumed by said catching device and by the garment.

3. Apparatus according to claim 2, wherein said claws have their tips close to each other, at the level of the central axis of said catching device and pointing toward the opening in the garment when said opening device is closed, and held at the outlet station of the first machine which produces the pantyhoses.

4. Apparatus according to claim 2, wherein said arms move on a vertical plane, perpendicular to the central axis of said catching device.

5. Apparatus according to claim 2, wherein said shafts are subjected to a two-stage rotation for a total of 90°, in opposite directions, to obtain the opening out of the claws in two phases, the first of which makes it possible to act transversely upon the edge of the opening in the garment, and the second enables said claws to move away from the garment.

6. Apparatus according to claim 2, wherein said arms are subjected to a 90° rotation around themselves, during the interval comprised between the two stages during rotation of said horizontal shafts, to enable said claws to move out backwards from the opening in the garment.

7. Apparatus according to claim 2, including a cart for operating said carriage, said carriage beginning its outward run with a delay relative to said cart, to enable the tips of said claws to be introduced into the opening in the garment before its opening out.

8. Apparatus for the automatic transfer of pantyhose from a first machine for seaming pantyhose to a second machine for applying a gusset to the pantyhose, wherein the pantyhoses leaving the first machine each have a transverse opening to which the gusset is to be applied, and the gusset applying machine includes tubes into which the legs of the pantyhose are drawn, comprising:

a pronged gripping device having prongs adapted to enter into the transverse opening for gripping the pantyhose;

a pair of arms symmetrically positioned relative to one of said tubes;

a shaft for each of said arms onto which said arms are articulated, said shafts being rotatable about their own axes and movable relative to each other;

claws for gripping the pantyhose at the edge of the transverse opening to permit said prongs to enter into said transverse opening; and means to open said prongs to open the transverse opening to its maximum extent prior to applying the gusset.

9. Apparatus as claimed in claim 8, wherein each of said claws is of triangular shape, each having a flat shape and a pointed portion bent at right angles.

10. Apparatus according to claim 9, including a cart for operating said carriage, said carriage beginning its outward run with a delay relative to said cart, to enable the tips of said claws to be introduced into the opening in the garment before its opening out.

11. Apparatus according to claim 10, wherein said claws have their tips close to each other, at the level of the central axis of said pronged gripping device and pointing toward the opening in the garment when said opening device is closed, and held at the outlet station of the first machine which produces the pantyhoses.

12. The process of claim 1, including employing two arms identically and symmetrically oriented relative to said tubes rotatable around themselves and in opposite directions, each carrying a claw for introducing the claws into the garment opening.

13. The process of claim 12, including moving the pantyhose with a cart to permit the tips of the claws to be securely introduced into the pantyhose opening and to return the pantyhose to its initial position.

14. The process of claim 1, including rotating the arms towards the outside of the garment for placement thereof onto the prongs, and opening the prongs to their maximum extent so as to move beyond the garment.

15. The process according to claim 14, wherein said arms move on a vertical plane, perpendicular to the central axis of the prongs.

16. The process of claim 15, wherein said arms are subjected to a 90° rotation around themselves, during the interval comprised between the two stages during rotation of the horizontal shafts to enable the claws to move out backwards from the opening in the garment.

17. The process according to claim 16, including subjecting the shafts to a two-stage rotation for a total of 90°, in opposite directions, to obtain the opening out of the claws in two phases, the first of which makes it possible to act transversely upon the edge of the opening in the garment, and the second enables the claws to move away from the garment.

* * * * *